US005596795A

United States Patent [19]

Beisswenger

[11] Patent Number: 5,596,795

[45] Date of Patent: Jan. 28, 1997

[54] SEAT BELT BUCKLE

[75] Inventor: Dieter Beisswenger, Enderbach, Germany

[73] Assignee: TRW Repa GmbH, Alfdorf, Germany

[21] Appl. No.: 428,576

[22] Filed: Apr. 25, 1995

[30] Foreign Application Priority Data

May 9, 1994 [DE] Germany ..... 44 16 301.0

[51] Int. Cl.[6] ..... A44B 11/26

[52] U.S. Cl. ..... 24/633; 24/642

[58] Field of Search ..... 24/633, 640–642; 297/468

[56] References Cited

U.S. PATENT DOCUMENTS 4,597,141 7/1986 Wier ..... 24/633

5,195,224 3/1993 Bock et al. ..... 24/633 X 5,213,365 5/1993 Fohl ..... 24/633 X 5,280,699 1/1994 Nanbu et al. ..... 24/633 X 5,309,611 5/1994 Wier et al. .

*Primary Examiner*—James R. Brittain

*Attorney, Agent, or Firm*—Tarolli, Sundheim, Covell, Tummino & Szabo

[57] ABSTRACT

A seat belt buckle based on the proven latching pawl design is equipped with simple measures to render it tensioner compatible. The latching pawl is locked in its latching position by a pin-type catch which is preloaded by a compression spring to a retracted position, but shifted into a blocking position in response to high acceleration of the buckle in which it protrudes into the guiding channel of the latching pawl.

5 Claims, 1 Drawing Sheet

SEAT BELT BUCKLE

The invention relates to a seat belt buckle.

In a seat belt buckle shown in U.S. Pat. No. 5,309,611, a load-bearing frame has an insertion path for an insertion tongue. A latching pawl is movable transverse to the insertion path. A release button is slidably guided on the frame and when actuated, engages the latching pawl shifting it from a latching position to a release position.

When a buckle of this kind is used in a restraining system with a belt tensioner engaging the buckle and shifting it in the direction of the vehicle floor, special measures must be taken to prevent the buckle from opening in the course of belt tensioning. In fact, the release button is actuated in the same direction by being pressed and has a tendency, due to its mass inertia, to perform an opening stroke when the buckle is abruptly decelerated at the end of the tensioning stroke. In the known buckle these measures involve a locking lever being swivably mounted within the cap of the release button which swivels in response to acceleration and butts against one edge on the frame, so that further movement of the release button in the opening direction is prevented.

The present invention provides a buckle for seat belts which even for extremely high values of acceleration is reliably prevented from unintentional opening, maintaining a proven design of the locking structure in the buckle.

In accordance with the invention the buckle is provided with a catch which is slidably guided parallel to the actuating direction of the release button and loaded by a spring in a rest position and which is movable in a blocking position in response to acceleration in the direction of actuation of the release button by its mass inertia. In the blocking position, the catch protrudes into the guide path of the latching pawl to block the latter in its latching position. When the buckle is subjected to high acceleration in the direction of the opening stroke of the release button, i.e. at the start of the tensioning stroke, the preferably pin-shaped catch is moved by its mass inertia into the blocking position and clasps the top edge of the latching pawl engaged in an aperture of the insertion tongue. When the buckle is subsequently suddenly decelerated at the end of the tensioning stroke, due to its mass inertia the release button forces the latching pawl in the direction of its release position, the same as on an opening stroke, but now the latching pawl soon comes up against the catch protruding in its guide, the catch now being loaded transversely to its longitudinal direction and being thus clamped in its blocking position. Latching pawl and catch simultaneously counterlock each other as long as the release button is forced against the latching pawl. Subsequently, the catch is returned by the spring into its rest position so that the buckle can be opened without obstruction.

The buckle features high security against unintentional opening even in the presence of extremely high accelerations as are attained with especially powerful, particularly pyrotechnical tensioning drive units. For activating the latch the complete duration of the acceleration phase is available. On reversal of acceleration the catch is instantly clamped in its blocking position. The clamping forces exceed all others, for instance shock loads occurring in a complex accident scenario in the various directions, so that the buckle remains locked even under the harshest conditions.

The preferably pin-shaped catch and its guide can be easily integrated into existing, proven latching pawl buckle designs at little expense.

Further features and advantages of the invention will be apparent from the description and drawing to which reference is made and in which.

Figure 1:
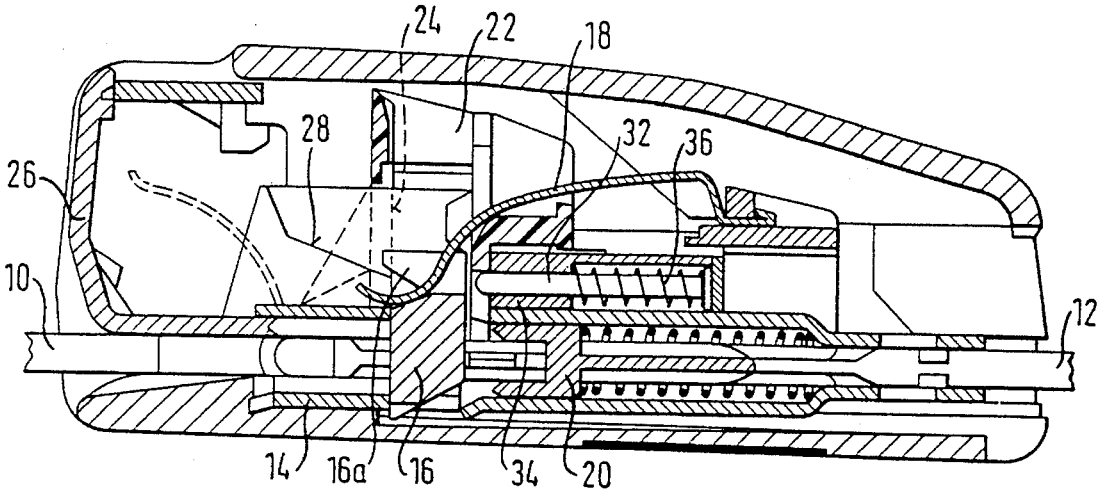
FIG. 1 is a section view of the buckle in the closed rest condition.

The seat belt buckle connects a conventional insertion tongue 10 to a fitting 12. A belt tensioner (not shown), a so-called buckle tensioner, engages on the fitting 12. The buckle comprises, connected to the fitting 12, a load-bearing frame 14 which in cross-section is formed U-shaped and stamped from a steel plate. Between the two parallel, flat webs of the frame 14 an insertion channel for the insertion tongue 10 is formed. Through a pair of aligned apertures in the webs of the frame 14 and through an aperture of the insertion tongue 10 a latching pawl 16 protrudes which is loaded by a leaf spring 18 in its latching position. The front end of the insertion tongue 10 is exposed to the pressure of a springloaded ejector 20. The latching pawl 16 is guided by a plastic guide part 22 mounted on the frame 14, a guiding channel 24 being formed in the guide part to guide the latching pawl 16.

A release button 26 is slidably guided on the frame 14 in the direction of insertion of the insertion tongue 10. On the release button 26 ramps 28 are formed which when actuated engage under two side wings **16*a*** of the latching pawl, forcing it upwards.

As described this far, the embodiment of a latching pawl buckle is conventional.

Figure 2:
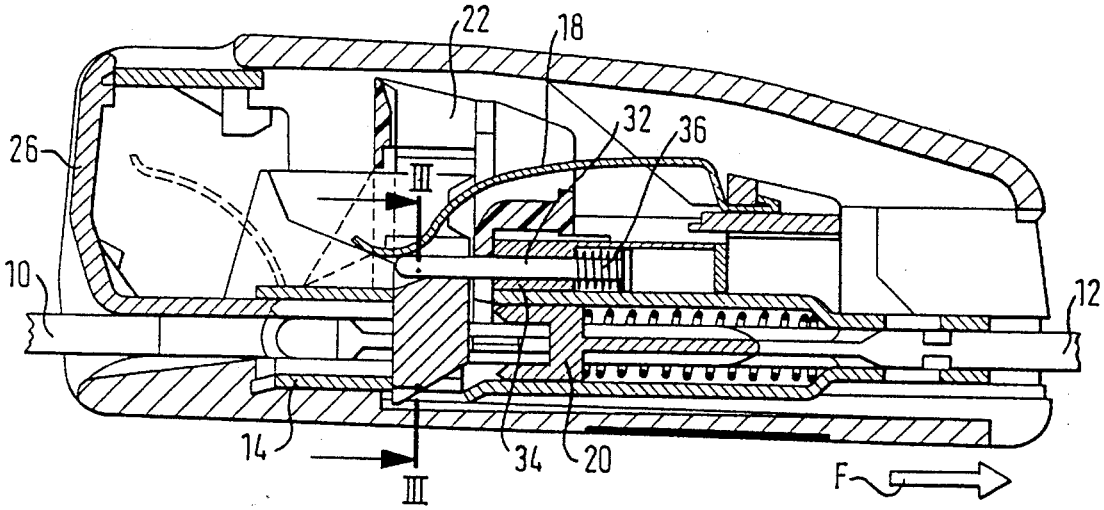
FIG. 2 is a section view of the same buckle subjected to a high acceleration.

To render this buckle safe to tensioner action, particularly to prevent it from opening unintentionally when a high acceleration occurs in the direction of an arrow F in FIG. 2, the buckle is provided with a pin-shaped catch 32 which is slidably guided in a bore through a guide member 34 parallel to the direction of actuation of the release button 26. The guide member 34 is mounted on a web of the frame 14, it may, however, also be molded to the guide part 22. The pin-shaped catch 32 features at its end facing away from the latching pawl 16 a collar and is surrounded by a helical spring 36 having an end bearing on the collar and an opposed end bearing on the guide member 34. The spring 36 maintains the catch 32 in a rest position retracted from latching pawl 16. In this condition, as shown in FIG. 1, the latching pawl 16 is freely movable in its guide passage 24 when the release button 26 is actuated.

When a high acceleration occurs in the direction of the arrow F as shown in FIG. 2 the catch 32 tends by reason of its mass inertia to remain in its position. It is thus moved relative to the frame 14 of the buckle against the force of the spring 36 and protrudes with its free end into the guide passage 24, thus blocking travel of the latching pawl 16 into its opening position.

Figure 3:
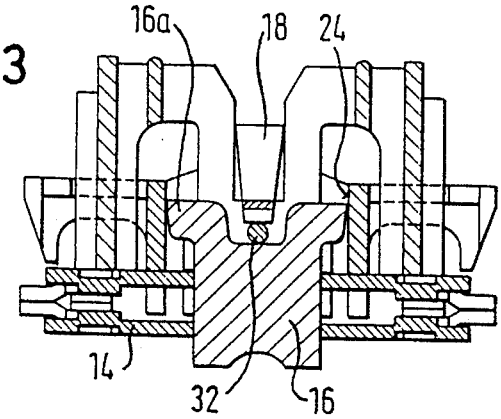
FIG. 3 is a section view along line III—III in FIG. 2.

With a subsequent reversal in movement at the end of the tensioner stroke the release button 26 tends to retain its movement, this movement corresponding to the normal opening stroke of the release button 26. The latter thus engages by its ramps 28 under the side wings **16*a* of the latching pawl 16 and forces it upwards against the extended catch 32. The catch 32 is then loaded transversely to its longitudinal direction and clamped in the bore of of the guide housing 34. In this condition, as shown in FIG. 3, the latching pawl 16 and the catch 32 block each other, resulting lastly in the latching pawl 16** being blocked in its latching position.

When the decleration of the release button 26 ceases on completion of belt tensioning, the pressure of the latching pawl 16 on the catch 32 is reduced so that the catch is returned by the spring 36 to the retracted position. The buckle can then be opened without obstruction by pressing the release button 26.

What is claimed is:

1. A seat belt buckle comprising a frame wherein an insertion channel for an insert tongue is formed, a pawl movable in said frame transverse to said insertion channel between a latching position and a release position, a release button slidably guided on said frame in a direction parallel to said insertion channel, said release button, when depressed, engaging said pawl and moving said pawl to the release position, and a catch slidably guided in a direction parallel to said insertion channel between a blocking position and a retracted position, said catch being biased by a spring to the retracted position and movable into said blocking position by inertia when the buckle is exposed to a predetermined acceleration in a direction in which the release button moves upon depression, and said catch, when in said blocking position, engaging the pawl and blocking the pawl in the latching position.

2. The buckle of claim 1, wherein said catch is formed by a pin.

3. The buckle of claim 2, wherein said spring is a helical spring engaged around said pin.

4. The buckle of claim 3, and further comprising a guide member mounted on said frame, said guide member having a bore and said pin being slidably mounted in said bore.

5. The buckle of claim 4, wherein said pin has an end facing away from said pawl and provided with a collar, and said spring having a first end bearing on said collar and a second end bearing on a surface portion of said guide member surrounding said bore.

* * * * *